US009106997B2

(12) United States Patent
Burgett et al.

(10) Patent No.: US 9,106,997 B2
(45) Date of Patent: Aug. 11, 2015

(54) BEHIND THE EAR EARPHONE

(71) Applicant: Harman International Industries, Incorporated, Stamford, CT (US)

(72) Inventors: Seth D. Burgett, Glen Carbon, IL (US); Aaron Gorga, St. Louis, MO (US); Effrosini A. Karayiannis, St. Louis, MO (US)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 14/214,468

(22) Filed: Mar. 14, 2014

(65) Prior Publication Data

US 2014/0270317 A1 Sep. 18, 2014

Related U.S. Application Data

(60) Provisional application No. 61/781,279, filed on Mar. 14, 2013.

(51) Int. Cl.
*H04R 1/10* (2006.01)

(52) U.S. Cl.
CPC ..... *H04R 1/105* (2013.01); *H04R 1/1066* (2013.01); *H04R 2225/63* (2013.01)

(58) Field of Classification Search
CPC ..... H04R 1/10; H04R 1/1008; H04R 1/1016; H04R 1/105; H04R 1/1066; H04R 1/1091; H04R 25/02; H04R 25/60; H04R 25/65; H04R 25/652; H04R 2225/63
USPC ..... 381/312, 322, 325, 328, 329, 330, 370, 381/371, 374, 379, 380, 381; 181/128, 129, 181/130, 135; 379/430, 433.01–433.13
See application file for complete search history.

(56) References Cited

U.S. PATENT DOCUMENTS

| | | | | |
|---|---|---|---|---|
| 4,893,344 | A * | 1/1990 | Tragardh et al. | 381/381 |
| 6,233,344 | B1 * | 5/2001 | Clegg et al. | 381/374 |
| 6,418,230 | B1 | 7/2002 | McDonald et al. | |
| 6,427,018 | B1 | 7/2002 | Keliiliki | |
| 7,123,737 | B2 * | 10/2006 | Ham | 381/381 |
| 7,684,581 | B2 * | 3/2010 | Wagner et al. | 381/330 |
| 8,320,603 | B2 * | 11/2012 | Bass | 381/381 |
| D695,719 | S | 12/2013 | Burgett et al. | |
| 2002/0041697 | A1 * | 4/2002 | MacDonald et al. | 381/381 |
| 2003/0112991 | A1 * | 6/2003 | Rapps | 381/330 |

(Continued)

OTHER PUBLICATIONS

International Search Report for PCT/US2014/029735 dated Jul. 25, 2014.

*Primary Examiner* — Curtis Kuntz
*Assistant Examiner* — Joshua A Kaufman
(74) *Attorney, Agent, or Firm* — Brooks Kushman P.C.

(57) ABSTRACT

A behind-the-ear mountable earphone includes a generally C-shaped ear support. The support has a first section extending between a first end and the top of the "C", adapted to fit behind the user's ear, and a second section extending from the top of the "C" to a second end. The second section is in a plane different from the first section, so that when the first section is behind the user's ear, the second section extends over the front of the user's ear. An earphone is telescopingly mounted on the second end of the C-shaped support. The earphone comprising a generally circular face adapted to be received in the concha of the user's ear, the generally circular face disposed at an angle with respect to the first section of the generally C-shaped support.

5 Claims, 4 Drawing Sheets

(56) References Cited

U.S. PATENT DOCUMENTS

| | | | | |
|---|---|---|---|---|
| 2008/0080704 | A1* | 4/2008 | te Riet | 379/430 |
| 2008/0310666 | A1 | 12/2008 | Wengreen | |
| 2009/0116678 | A1* | 5/2009 | Bevirt et al. | 381/381 |
| 2009/0180653 | A1* | 7/2009 | Sjursen et al. | 381/322 |
| 2011/0091060 | A1* | 4/2011 | von Dombrowski et al. | 381/328 |
| 2011/0091061 | A1* | 4/2011 | von Dombrowski et al. | 381/330 |
| 2011/0164778 | A1* | 7/2011 | Wengreen | 381/381 |
| 2012/0052924 | A1* | 3/2012 | Cybart et al. | 455/569.1 |
| 2012/0155691 | A1* | 6/2012 | Chen | 381/380 |

* cited by examiner

BEHIND THE EAR EARPHONE

CROSS-REFERENCE TO RELATED APPLICATIONS

This application claims priority to U.S. Provisional Patent Application Ser. No. 61/781,279, filed Mar. 14, 2013. The entire disclosure of the above-referenced application is incorporated herein.

FIELD

The present disclosure relates to earphones, and in particular to a behind the ear earphone.

BACKGROUND

This section provides background information related to the present disclosure which is not necessarily prior art.

There are many types of earphones available to accommodate various user preferences. Many users are satisfied with in the ear earphones, which engage the ear canal or the concha of the ear. However, some users find in the ear earphones, which rely on contact with the ear canal or interior parts of the ear, uncomfortable or not secure enough. Various styles of behind the ear earphones have been developed, but some of the designs can cause irritation behind the user's ear, and some of these designs cannot accommodate varying sizes of the user's ears.

SUMMARY

This section provides a general summary of the disclosure, and is not a comprehensive disclosure of its full scope or all of its features.

Embodiments of the present invention provide improved behind the ear earphones. Generally, a preferred embodiment of a behind-the-ear mountable earphone comprises a generally C-shaped ear support. The support comprises a first section extending between a first end and the top of the "C", adapted to fit behind the user's ear, and a second section extending from the top of the "C" to a second end. The second section is in a plane different from the first section, so that when the first section is behind the user's ear, the second section extends over the front of the user's ear. An earphone is telescopingly mounted on the second end of the C-shaped support. The earphone, comprising a generally circular face, adapted to be received in the concha of the user's ear. The generally circular face of the earphone is disposed at an angle with respect to the first section of the generally C-shaped support, such that the earphone generally faces the user's ear.

In a preferred embodiment of the behind-the-ear mountable earphones, the generally circular face of the earphone is at an angle of between about 25° and about 35° with respect to the plane of the first section, and more preferably about 30°.

The earphone can optionally include an enhancer mounted over the face of the earphone, the enhancer including a sound tunnel adapted to fit in the ear canal. The sound tunnel is at an angle of between about 50° and about 70° with respect to the plane of the first section, and more preferably about 60°, so that the longitudinal axis of the sound tunnel is generally parallel to the longitudinal axis of the ear canal.

In one preferred embodiment, the first portion of the C-shaped support comprises an outer layer of a relatively stiffer, hard plastic, an intermediate layer of a relatively less stiff and less hard plastic. The C-shaped support can further comprise an inner layer of a relatively less stiff and less hard plastic than the intermediately layer, for engaging the crease between the head and the ear.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
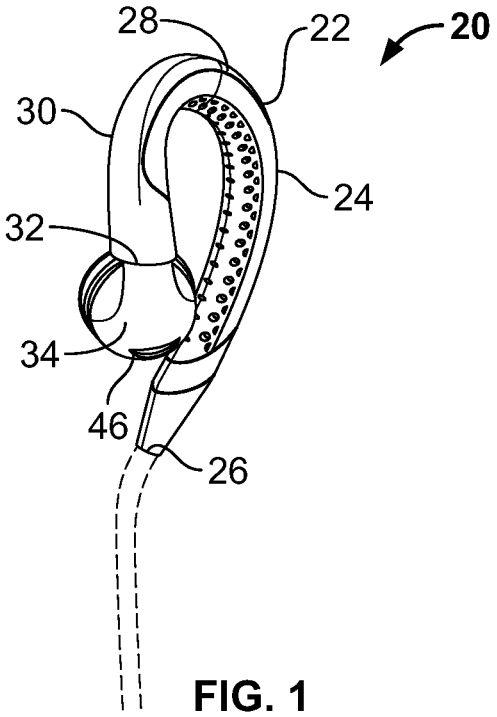
FIG. 1 is a front perspective view of a preferred embodiment of a behind the ear earphone, in accordance with the principles of this invention.
Figure 5:
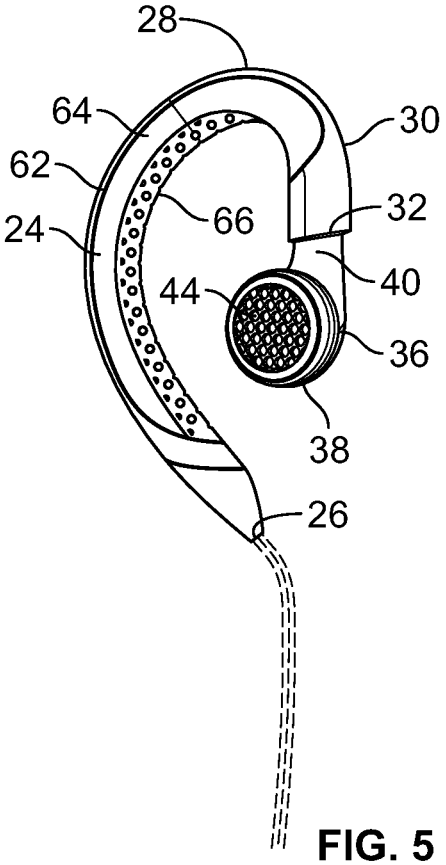
FIG. 5 is a left-side elevation view of the behind the ear earphone.
Figure 3:
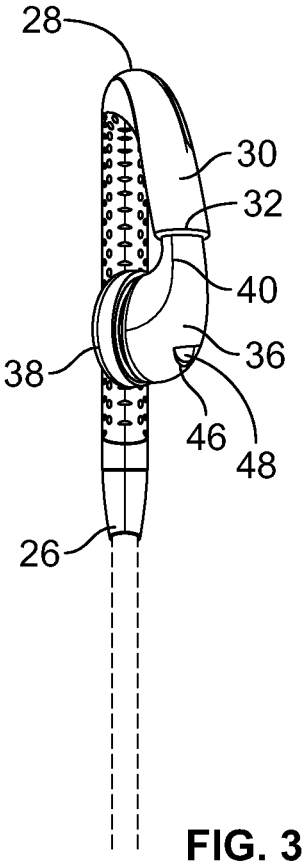
FIG. 3 is a front elevation view of the behind the ear earphone.
Figure 2:
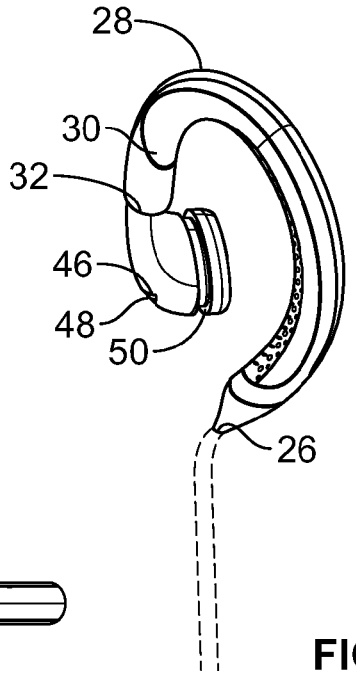
FIG. 2 is a rear perspective view of the behind the ear earphone.
Figure 7:
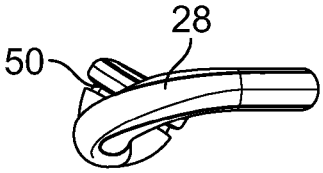
FIG. 7 is a top plan view of the behind the ear earphone.
Figure 6:
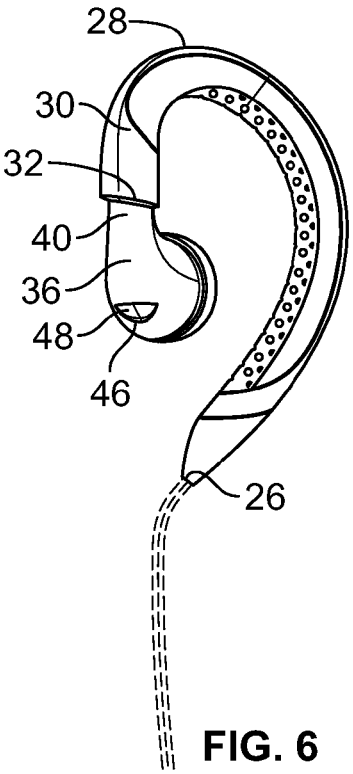
FIG. 6 is a right-side elevation view of the behind the ear earphone.
Figure 4:
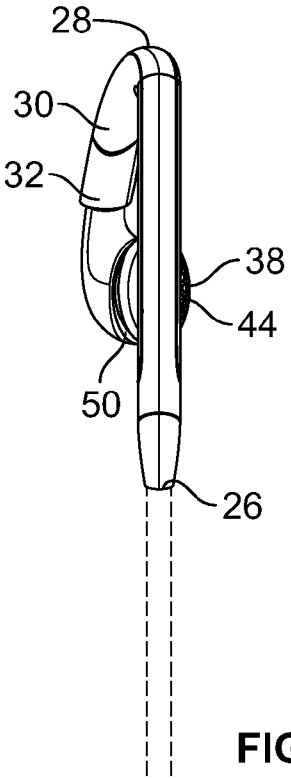
FIG. 4 is a rear elevation view of the behind the ear earphone.
Figure 8:
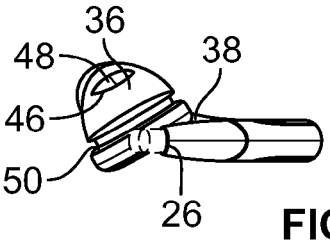
FIG. 8 is a bottom plan view of the behind the ear earphone.

Example embodiments will now be described more fully with reference to the accompanying drawings.

Embodiments of the present invention provide improved behind the ear earphones. A preferred embodiment of a behind-the-ear mountable earphone is indicated generally as 20 in the Figures. Earphone 20 comprises a generally C-shaped ear support 22. The support 22 comprises a first section 24 extending between a first end 26 and the top 28 of the "C", adapted to fit behind the user's ear. The support further comprises a second section 30 extending from the top 28 of the "C" to a second end 32. The second section 30 is in a plane different from the first section 24, so that when the first section is behind the user's ear, the second section extends over the front of the user's ear.

An earphone 34 is telescopingly mounted on the second end 32 of the C-shaped support 22. The earphone 34 preferably comprises a body 36 with a generally circular face 38 adapted to be received in the concha of the user's ear. A wire guide 40 extends generally perpendicularly to the body 36, generally parallel to the circular face 38. The end of the wire guide 40 extends into the second end 32 of the C-shaped support 22 to telescopingly mount the earphone 34 to the support. The end of the wire guide 40 and the second end 32 of the C-shaped support 22, preferably have a corresponding cross-section (e.g., elliptical), so that the earphone 34 can slide, but not rotate, relative to the C-shaped support 22.

A speaker (not shown) is preferably disposed in the body 36 of the housing, oriented toward the front face 38. A grille 44 can be provided so that the sound can pass from the speaker to the user's ear. The back of the body 36 can have an arcuate groove 46 with a vent 48 to facilitate the sonic performance of the speaker.

In a preferred embodiment of the behind-the-ear mountable earphone, the generally circular face 38 of the earphone is at an angle of between about 25° and about 35° with respect to the plane of the first section 22, and more preferably about 30°.

Figure 9:
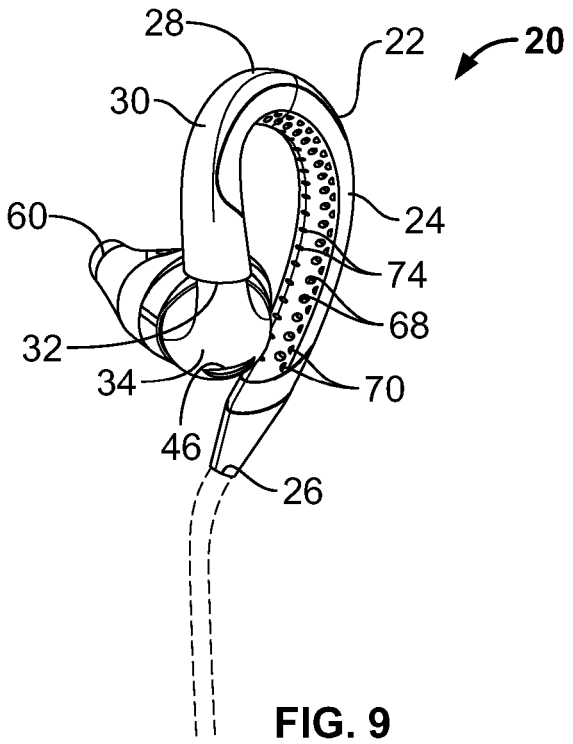
FIG. 9 is a front perspective view of the preferred embodiment of a behind the ear earphone, in accordance with the principles of this invention, with an optional enhancer.
Figure 13:
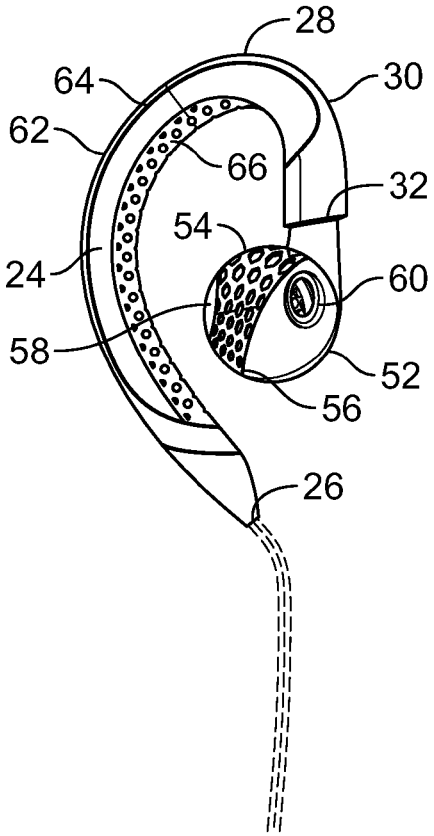
FIG. 13 is a left-side elevation view of the behind the ear earphone, with the optional enhancer.
Figure 11:
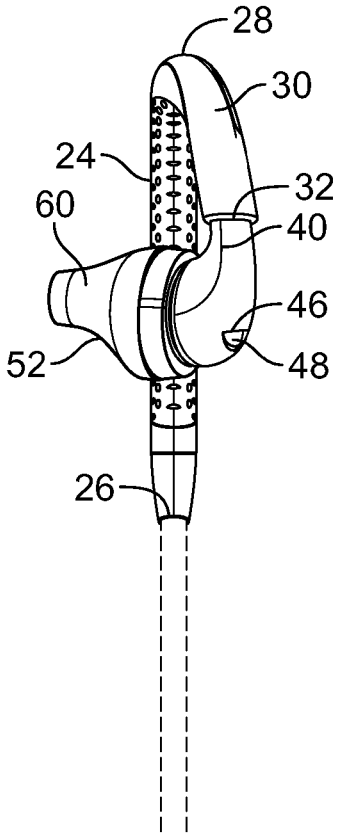
FIG. 11 is a front elevation view of the behind the ear earphone, with the optional enhancer.
Figure 15:
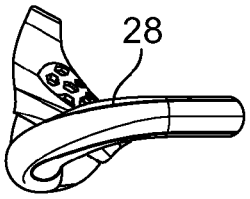
FIG. 15 is a top plan view of the behind the ear earphone, with the optional enhancer.
Figure 10:
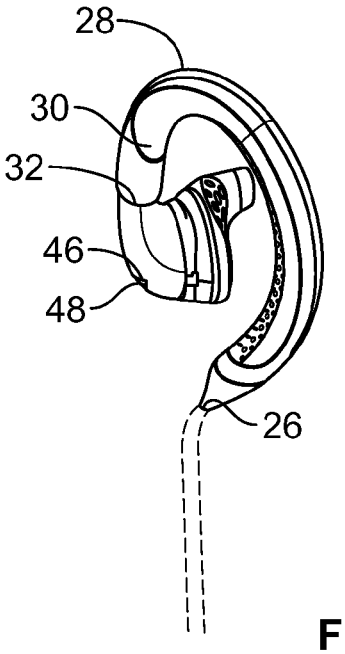
FIG. 10 is a rear perspective view of the behind the ear earphone, with the optional enhancer.
Figure 14:
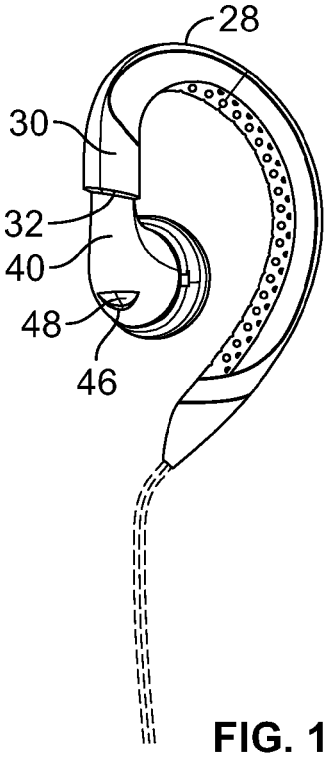
FIG. 14 is a right-side elevation view of the behind the ear earphone, with the optional enhancer.
Figure 12:
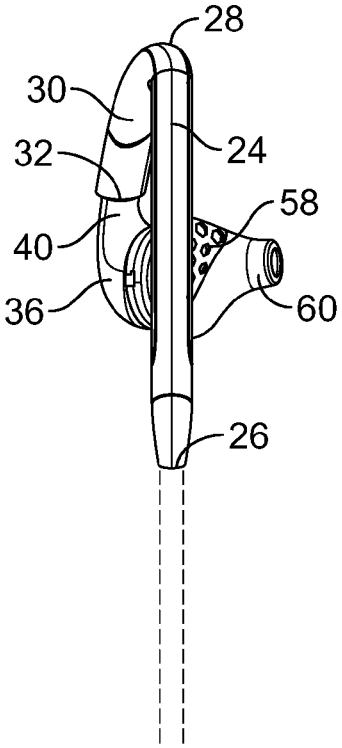
FIG. 12 is a rear elevation view of the behind the ear earphone, with the optional enhancer.
Figure 16:
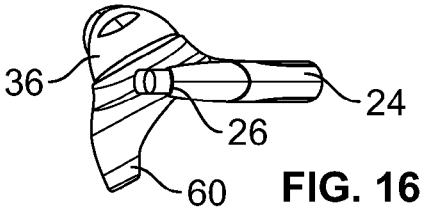
FIG. 16 is a bottom plan view of the behind the ear earphone, with the optional enhancer.

There is preferably a circumferential groove 50 in the body 36, just behind the front face 38, for mounting an interface or enhancer 52, as shown in FIGS. 9-16. The enhancer 52 engages with and acoustically connects to a user's ear, and comprises a hollow, flexible body 54 that is adapted to fit in the concha of the user's ear. The body 54 has a generally oval perimeter that generally corresponds to the perimeter of the concha. The body 54 further has a generally smooth, generally flat oval contact face 56 adapted to overlie the surface of the concha of the user's ear. The contact face 56 has an elongate crus relief groove 58 extending transversely across it for accommodating the crus of helix of the user's ear. The crus relief groove 58 has a pattern formed therein to make the surface more flexible to reduce the area of contact between the enhancer 52 and the crus of helix of the user's ear. A tube 60 projects from the generally flat oval contact face adjacent one end, and is adapted to extend into the user's ear canal. The tube having a generally elliptical cross-section with a circumference less than the circumference of the ear canal, so that the tube does not contact the surface of the ear canal around its entire circumference. However, a plurality of generally flexible planar, elliptical vanes project from the exterior of the tube to engage the walls of the ear canal. The enhancer 52 preferably has a circular flange adapted to be received in the groove 50 to retain the enhancer 52 on the earphone 34.

The tube or sound tunnel 60 is at an angle of between about 50° and about 70° with respect to the plane of the first portion 24, and more preferably about 60°, so that the longitudinal axis of the sound tunnel or tube is generally parallel to the longitudinal axis of the ear canal.

In one preferred embodiment, the first portion 24 of the C-shaped support 22 comprises an outer layer 62 of a relatively stiffer, hard plastic, and an intermediate layer 64 of a relatively less stiff and less hard plastic. The C-shaped support 22 can further comprise an inner layer 66 of a relatively less stiff and less hard plastic than the intermediate layer 64, for engaging the crease between the head and the ear. The inner layer 66 can have a number of features formed to enhance its flexibility, for example, a plurality of transverse through holes 68 and indents 70. The interior face of the inner layer 66 can have a plurality of spaced transverse grooves 72 along its length, to improve engagement with the crease between the user's head and ear.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A behind-the-ear mountable earphone comprising:

a generally C-shaped ear support, the support comprising a first section extending between a first end and the top of the "C", adapted to fit behind the user's ear, and a second section extending from the top of the "C" to a second end, the second section in a plane different from the first section, so that when the first section is behind the user's ear, the second section extends over the front of the user's ear; and an earphone telescopingly mounted on the second end of the C-shaped support, the earphone and the C-shaped support having corresponding cross-sections that allow the earphone to slide but not rotate relative to the C-shaped support, the earphone comprising a generally circular face adapted to be received in the concha of the user's ear, the generally circular face disposed at an angle with respect to the first section of the generally C-shaped support.

2. The behind-the-ear mountable earphone according to claim 1, wherein the circular face is at an angle of between about 25° and about 35° with respect to the plane of the first section.

3. The behind-the-ear mountable earphone according to claim 1, further comprising an enhancer mounted over the face of the earphone, the enhancer including a sound tunnel.

4. The behind-the-ear mountable earphone according to claim 3, wherein the sound tunnel is at an angle of between about 50° and about 70° with respect to the plane of the first section.

5. The behind-the-ear mountable earphone according to claim 1, wherein the first section of the C-shaped support comprises an outer layer of a relatively hard plastic, an intermediate layer of a relatively softer plastic, and further comprising an enhancer mounted over the face of the earphone, the enhancer including a sound tunnel.

* * * * *